US009591951B2

(12) United States Patent
Rukavina

(10) Patent No.: US 9,591,951 B2
(45) Date of Patent: Mar. 14, 2017

(54) CONVERSION VALVE FOR A VACUUM CLEANER

(71) Applicant: Techtronic Industries Co. Ltd., Tsuen Wan, New Territories (HK)

(72) Inventor: Douglas M. Rukavina, Massillon, OH (US)

(73) Assignee: Techtronic Industries Co. Ltd., Tsuen Wan, New Territories (HK)

( * ) Notice: Subject to any disclaimer, the term of this patent is extended or adjusted under 35 U.S.C. 154(b) by 33 days.

(21) Appl. No.: 14/521,950

(22) Filed: Oct. 23, 2014

(65) Prior Publication Data

US 2016/0113454 A1 Apr. 28, 2016

(51) Int. Cl.

| | |
|---|---|
| ***A47L 5/28*** | (2006.01) |
| ***A47L 5/22*** | (2006.01) |
| ***A47L 5/32*** | (2006.01) |
| ***A47L 9/00*** | (2006.01) |

(52) U.S. Cl.

CPC ..... *A47L 5/225* (2013.01); *A47L 5/28* (2013.01); *A47L 5/32* (2013.01); *A47L 9/0072* (2013.01)

(58) Field of Classification Search

CPC ..... A47L 5/28; A47L 5/225; A47L 5/32

See application file for complete search history.

(56) References Cited

U.S. PATENT DOCUMENTS 5,222,276 A 6/1993 Glenn, III
5,243,734 A 9/1993 Maurer et al.
5,247,720 A 9/1993 Sovis et al.
5,351,361 A 10/1994 Buchtel
5,477,586 A * 12/1995 Jacobs ..... A47L 5/32 15/332
5,551,120 A * 9/1996 Cipolla ..... A47L 5/32 15/333
5,560,074 A 10/1996 Graham et al.
5,715,566 A 2/1998 Weaver et al.
5,732,439 A * 3/1998 Cipolla ..... A47L 5/32 15/334
6,079,077 A * 6/2000 Kajihara ..... A47L 9/242 15/331
6,317,921 B1 11/2001 Park et al.
6,442,791 B1 9/2002 McRae Thomson et al.
(Continued)

OTHER PUBLICATIONS

International Search Report and Written Opinion for Application No. PCT/US2015/055688 dated Feb. 1, 2016 (14 pages).

*Primary Examiner* — Dung Van Nguyen

(74) *Attorney, Agent, or Firm* — Michael Best & Friedrich LLP

(57) ABSTRACT

A vacuum cleaner includes a suction source, an air inlet, and an airflow path extending from the air inlet to the suction source. A valve is movable between an open position in which the suction source and the air inlet are in fluid communication and a closed position in which the valve inhibits fluid communication between the air inlet and the suction source. The vacuum cleaner also includes a link coupled to the valve such that movement of the link in a first direction when the valve is in the closed position opens the valve, and movement of the link in a second direction when the valve is in the open position closes the valve. The link has a deformable portion resiliently deformable to permit additional movement of the link in the second direction when the valve is in the closed position.

13 Claims, 8 Drawing Sheets

(56) References Cited

U.S. PATENT DOCUMENTS

| | | | | |
|---|---|---|---|---|
| 6,510,584 | B2 * | 1/2003 | Vystrcil | A47L 5/32 15/332 |
| 6,536,074 | B2 | 3/2003 | Boles et al. | |
| 6,572,078 | B1 | 6/2003 | Thomson et al. | |
| 6,609,269 | B2 | 8/2003 | Kasper | |
| 7,069,619 | B2 | 7/2006 | Bowden et al. | |
| 7,124,467 | B2 | 10/2006 | Hitzelberger et al. | |
| 7,213,297 | B2 | 5/2007 | Nam et al. | |
| 7,356,874 | B2 | 4/2008 | Macleod et al. | |
| 7,367,081 | B2 | 5/2008 | O'Neal | |
| 7,386,915 | B2 | 6/2008 | Blocker et al. | |
| 7,533,441 | B2 * | 5/2009 | Yoo | A47L 5/32 15/331 |
| 7,555,810 | B2 | 7/2009 | Pullins et al. | |
| 7,559,112 | B2 | 7/2009 | Lee et al. | |
| 7,657,966 | B1 | 2/2010 | Schwartz | |
| 7,676,883 | B2 | 3/2010 | Macleod et al. | |
| 7,805,807 | B2 | 10/2010 | Blocker et al. | |
| 7,832,050 | B2 | 11/2010 | Pullins et al. | |
| 7,877,836 | B2 | 2/2011 | O'Neal | |
| 7,996,954 | B2 | 8/2011 | Lee et al. | |
| 8,020,252 | B2 | 9/2011 | Blocker et al. | |
| 8,032,982 | B2 | 10/2011 | Lee et al. | |
| 8,042,224 | B2 | 10/2011 | White et al. | |
| 8,091,174 | B2 | 1/2012 | Coburn et al. | |
| 8,122,566 | B2 | 2/2012 | Sepke et al. | |
| 8,127,398 | B2 | 3/2012 | Conrad | |
| 8,146,200 | B2 | 4/2012 | Krebs et al. | |
| 8,166,607 | B2 | 5/2012 | Conrad | |
| 8,205,294 | B2 | 6/2012 | Kim et al. | |
| 8,234,750 | B2 | 8/2012 | Hawkins et al. | |
| 8,561,255 | B2 * | 10/2013 | Seo | A47L 5/32 15/331 |
| 2002/0166196 | A1 * | 11/2002 | Boles | A47L 5/32 15/331 |
| 2009/0158548 | A1 | 6/2009 | Helps et al. | |
| 2010/0005611 | A1 | 1/2010 | Hong et al. | |
| 2011/0088197 | A1 | 4/2011 | Postle et al. | |
| 2011/0088202 | A1 | 4/2011 | Mcluckie et al. | |
| 2011/0088211 | A1 | 4/2011 | Dyson et al. | |
| 2011/0094054 | A1 | 4/2011 | Dos Reis et al. | |
| 2011/0219568 | A1 | 9/2011 | Conrad | |
| 2011/0265881 | A1 | 11/2011 | Morgan et al. | |
| 2011/0296647 | A1 | 12/2011 | Blocker et al. | |
| 2012/0066861 | A1 | 3/2012 | Louis et al. | |
| 2012/0180252 | A1 | 7/2012 | Lee | |

* cited by examiner

CONVERSION VALVE FOR A VACUUM CLEANER

FIELD OF THE INVENTION

The present invention relates to vacuum cleaners, and more particularly to upright vacuum cleaners.

BACKGROUND

Upright vacuum cleaners are typically used to clean floor surfaces, such as carpeting, by generating suction to draw air and dirt through a suction nozzle. The dirt is separated from the air inside the vacuum cleaner and clean air is discharged from the vacuum cleaner.

SUMMARY

The invention provides, in one aspect, a vacuum cleaner including a suction source, a base assembly including an air inlet, a handle assembly pivotally coupled to the base assembly for movement relative to the base assembly between an upright position and an inclined position, and an airflow path extending from the air inlet to the suction source. The vacuum cleaner further includes a valve including a pivot shaft, a valve body being rotatable with the pivot shaft, and a lever coupled to the pivot shaft such that rotation of the lever rotates the valve body between an open position in which the suction source and the air inlet are in fluid communication and a closed position inhibiting fluid communication between the air inlet and the suction source. The vacuum cleaner also includes a link engaging the lever. The link is movable in a first direction to open the valve and movable in a second direction to close the valve. At least one of the lever and the link has a deformable portion. The deformable portion is resiliently deformable to permit additional movement of the link when the valve body is stopped in the closed position or the open position.

The invention provides, in another aspect, a vacuum cleaner including a suction source, an air inlet, and an airflow path extending from the air inlet to the suction source. The vacuum cleaner further includes a valve movable between an open position in which the suction source and the air inlet are in fluid communication and a closed position in which the valve substantially blocks the airflow path to inhibit fluid communication between the air inlet and the suction source. The vacuum cleaner also includes a link coupled to the valve such that movement of the link in a first direction when the valve is in the closed position opens the valve, and movement of the link in a second direction when the valve is in the open position closes the valve. The link has a deformable portion resiliently deformable to permit additional movement of the link in the second direction when the valve is in the closed position.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
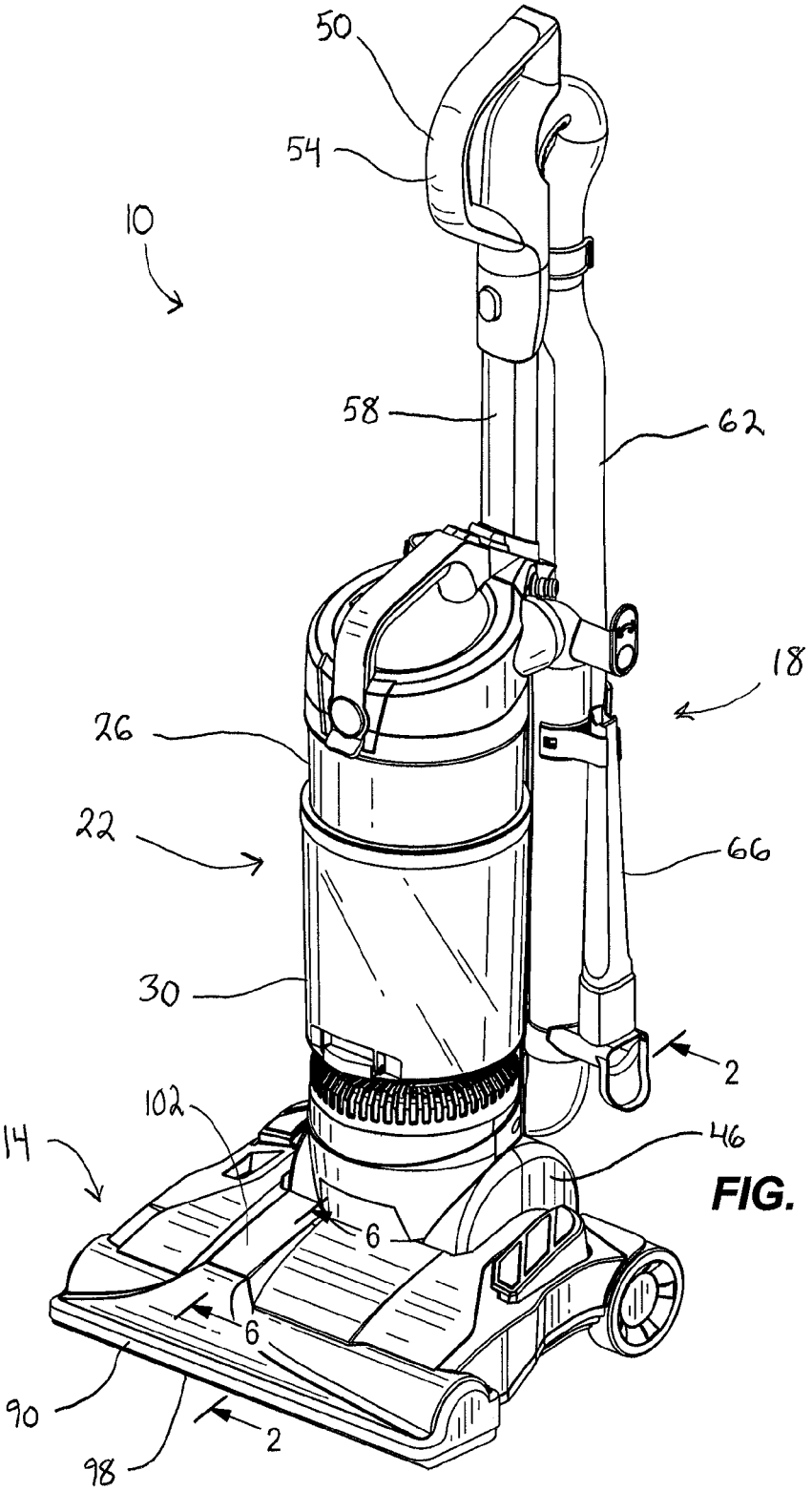
FIG. 1 is a perspective view of a vacuum cleaner according to one embodiment of the invention.

FIG. 1 illustrates an exemplary vacuum cleaner 10. The illustrated vacuum cleaner 10 is an upright vacuum cleaner 10 including a base assembly 14 and a handle assembly 18 pivotally coupled to the base assembly 14. The base assembly 14 is movable along a surface to be cleaned, such as a carpeted or hard-surface floor. The handle assembly 18 extends from the base assembly 14 and allows a user to move and manipulate the base assembly 14 along the surface. The handle assembly 18 is also movable relative to the base assembly 14 between an upright position (illustrated in FIGS. 1 and 2) and an inclined or operating position (not shown).

Figure 2:
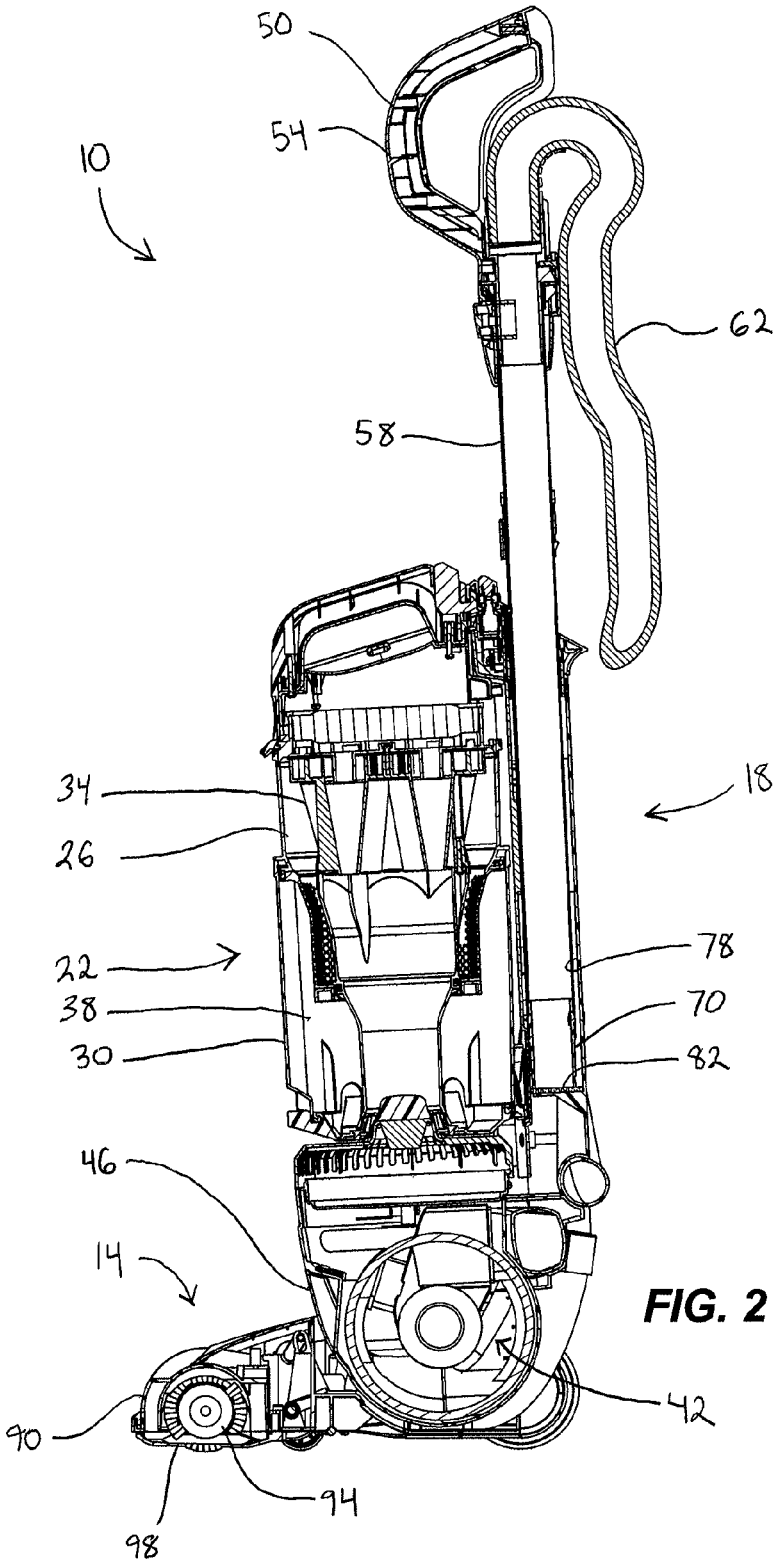
FIG. 2 is a cross-sectional view of the vacuum cleaner taken along line 2-2 in FIG. 1, illustrating a wand of the vacuum cleaner in a stowed position.

With reference to FIG. 2, a canister 22 is supported by the handle assembly 18 and includes a separator 26 and a dirt cup 30. The separator 26 removes dirt particles from air drawn into the vacuum cleaner 10, which are then collected by the dirt cup 30. In the illustrated embodiment, the separator 26 is a dual-stage cyclonic separator with a plurality of second stage cyclones 34 and a single first stage cyclone 38. In other embodiments, other separators can be used, such as single-stage cyclonic separators, filter bags, etc. At least a portion of the canister 22 may be removable from the handle assembly 18 to facilitate emptying the dirt particles from the dirt cup 30.

The vacuum cleaner 10 further includes a motor and fan assembly or suction source 42 contained within a motor housing 46. The illustrated motor housing 46 forms a lower portion of the handle assembly connecting the handle assembly 18 and the base assembly 14. The motor and fan assembly 42 selectively receives power from a power source (e.g., a cord for plugging into a source of utility power, a battery, etc.) to generate a suction airflow through the vacuum cleaner 10.

With continued reference to FIG. 2, the handle assembly 18 includes a maneuvering handle 50 having a grip 54 for a user to grasp and maneuver the vacuum cleaner 10. In the illustrated embodiment, the maneuvering handle 50 is coupled to a wand 58, and the maneuvering handle 50 and the wand 58 are removable from the remainder of the handle assembly 18 together as a unit. In other embodiments, the wand may be separate from and independent of the maneuvering handle 50. The wand 58 may be used to clean above-floor surfaces (e.g., stairs, drapes, corners, furniture, etc.). A flexible hose 62 is coupled to the wand 58 to provide a fluid flow path from the wand 58 to the separator 26. In the illustrated embodiment, the hose 62 extends from the wand 58 along an underside of the handle 50; however, the hose 62 may be coupled to the wand 58 in other ways. An accessory tool 66 (e.g., a crevice tool, an upholstery tool, a pet tool, etc.) may be detachably coupled to the handle assembly 18 for storage and may be selectively coupled to the wand 58 for specialized cleaning (FIG. 1).

Figure 3:
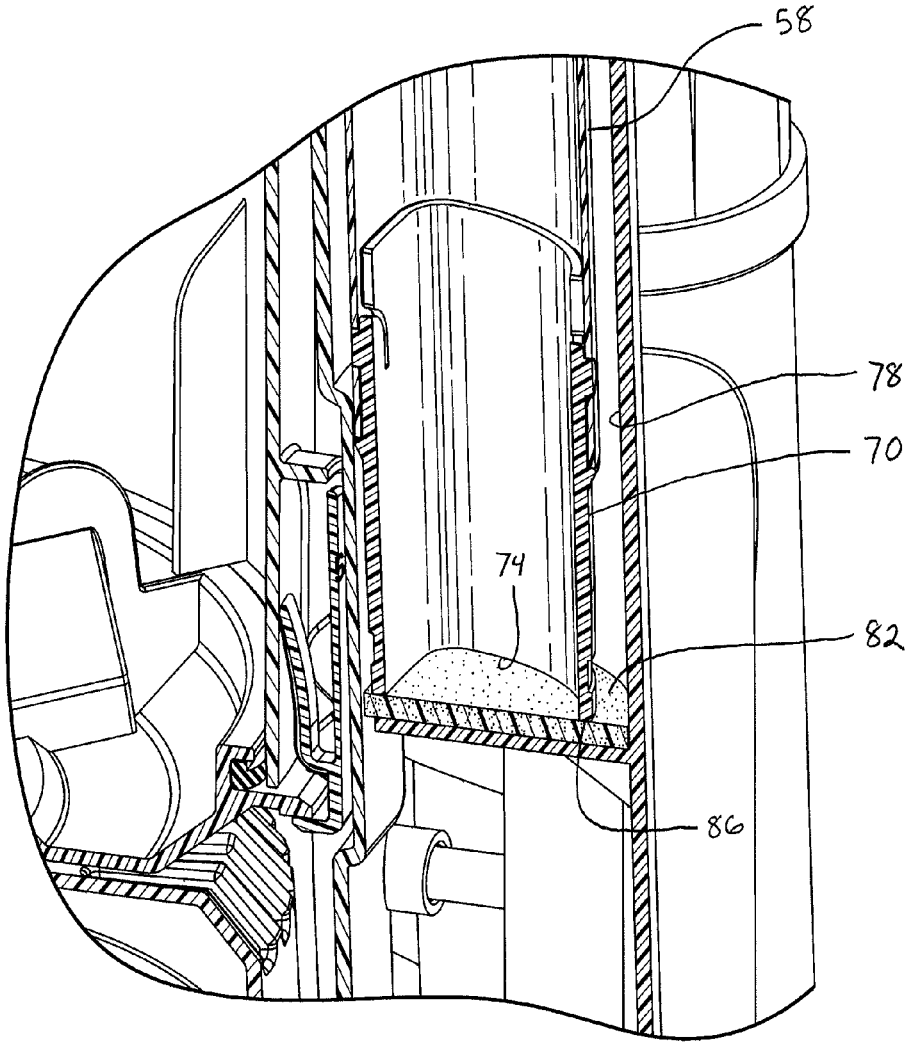
FIG. 3 is an enlarged view of a distal portion of the wand of FIG. 2.

Referring to FIG. 3, a distal portion 70 of the wand 58 includes a wand air inlet 74 into which air and debris may be drawn when the wand 58 is used for above-floor cleaning When the wand 58 is in a stowed position, in the illustrated embodiment shown in FIGS. 1-3, the distal portion 70 is received within a receptacle 78 extending along a rear portion of the handle assembly 18. Alternatively, the receptacle may be positioned on another location on the handle assembly or base and in any other orientation as desired for the application. The receptacle 78 includes a seal 82 that substantially seals the wand air inlet 74 when the wand 58 is stowed in the receptacle 78 to inhibit air from being drawn through the wand air inlet 74. In the illustrated embodiment, the seal 82 is a generally flat piece of foam or elastomeric material that abuts an end 86 of the wand 58 when the wand 58 is stowed. In alternative embodiments, the seal 82 may include a plug, one or more o-rings, or any other means for sealing the wand air inlet 74.

Referring to FIG. 2, the base assembly 14 includes a suction nozzle or floor nozzle 90 and a generally cylindrical agitator 94 rotatably supported within the floor nozzle 90 to agitate the surface to be cleaned. In the illustrated embodiment, the agitator 94 is driven by the motor and fan assembly 42 (e.g., via one or more drive belts or pulleys). In other embodiments, the agitator 94 may be driven by a separate motor, an air turbine, or any other suitable drive means. The floor nozzle 90 includes a floor nozzle air inlet 98 for drawing air and debris into the vacuum cleaner 10. After entering the floor nozzle 90, the air and debris flows along a nozzle outlet duct 102 (FIG. 1) that fluidly communicates with the separator 26 and the motor and fan assembly 42.

Figure 5:
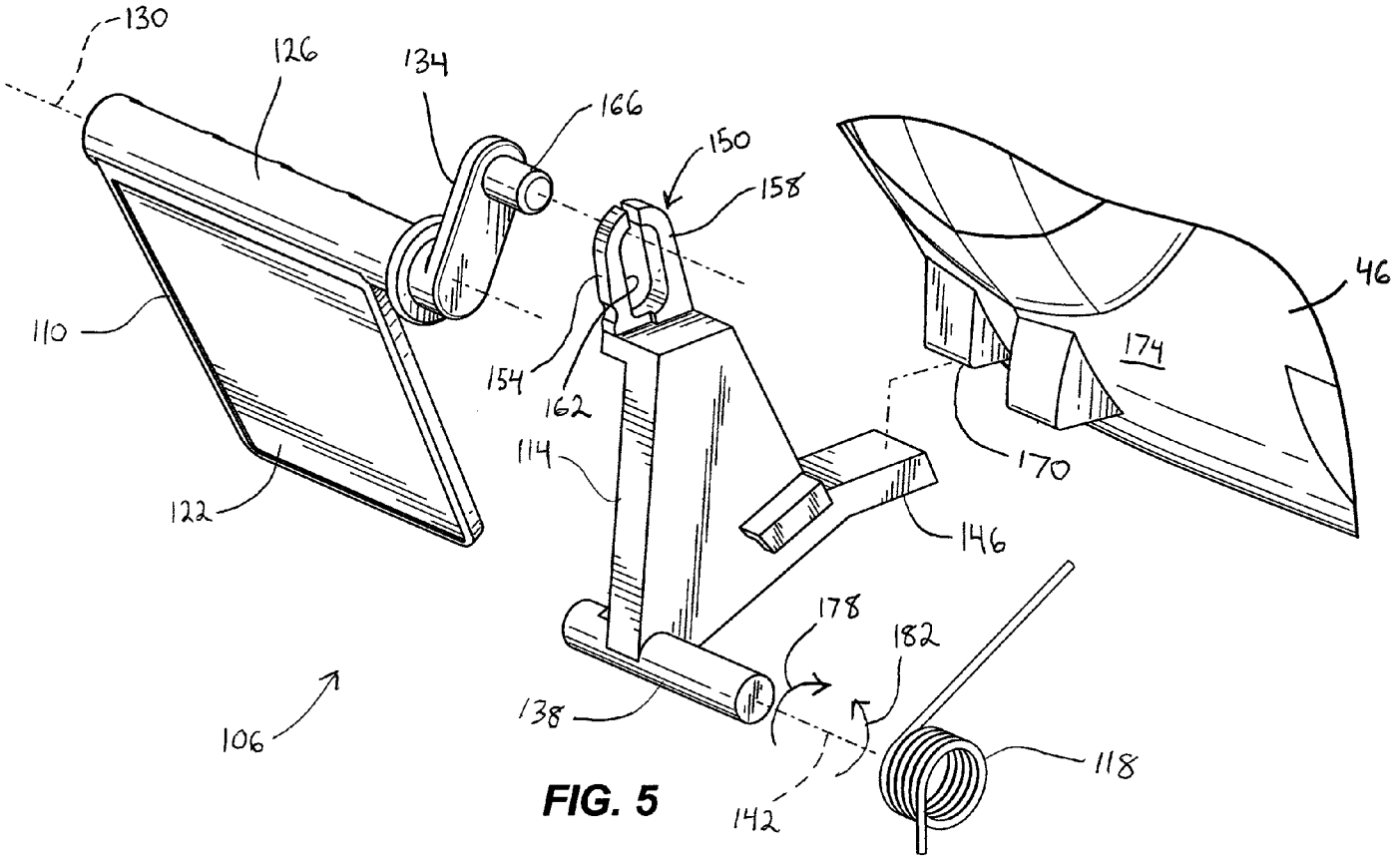
FIG. 5 is an exploded view of a valve assembly of the vacuum cleaner of FIG. 1.
Figure 6:
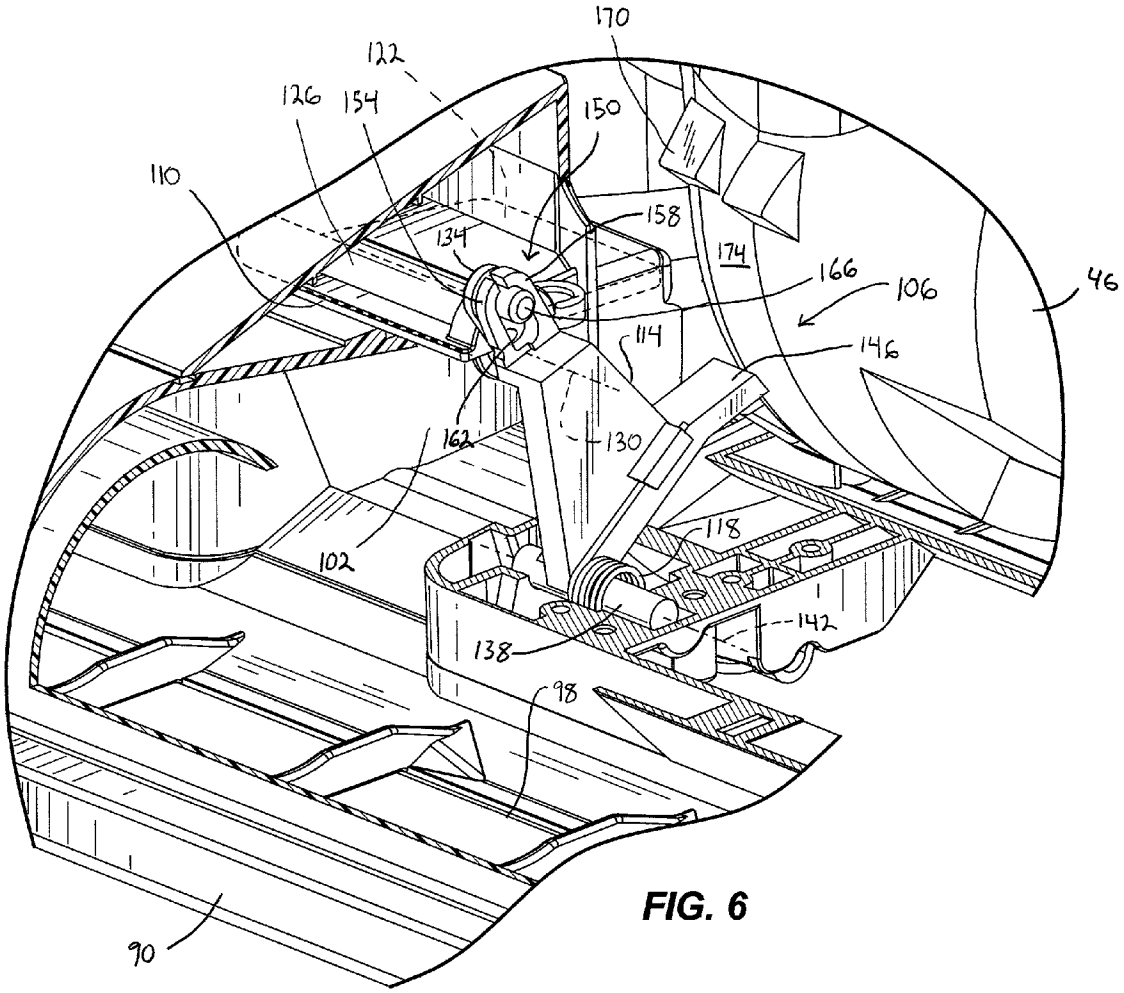
FIG. 6 is a cross-sectional view taken along line 6-6 in FIG. 1, illustrating the valve assembly in an open position.
Figure 7:
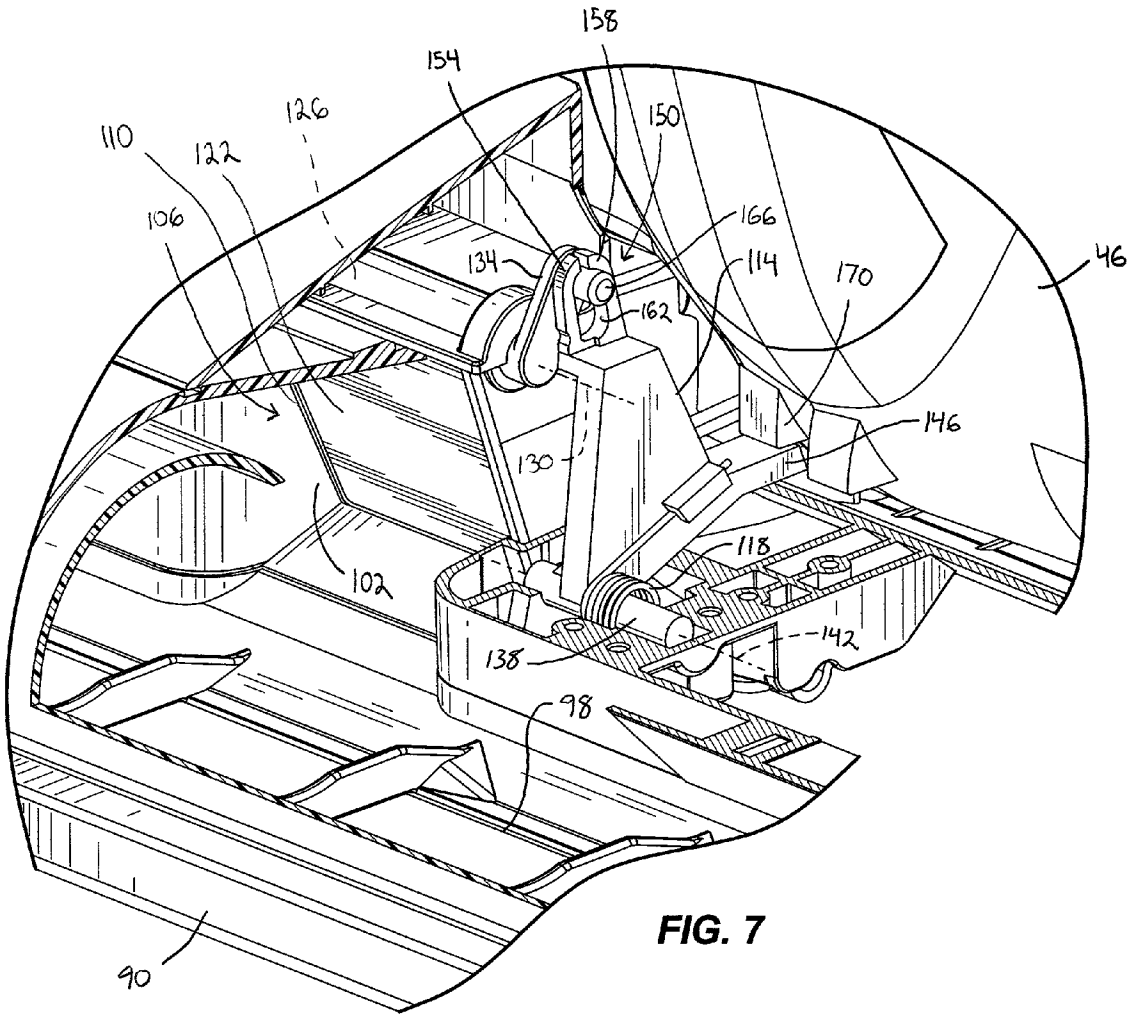
FIG. 7 is a cross-sectional view taken along line 6-6 in FIG. 1, illustrating the valve assembly in a closed position.

With reference to FIGS. 5-7, the vacuum cleaner 10 includes a valve assembly 106 that selectively blocks air flow through the nozzle outlet duct 102 so that the vacuum cleaner 10 may be converted between a floor cleaning mode and an above-floor cleaning mode, as described in greater detail below. The illustrated valve assembly 106 includes a valve element 110, a link 114, and a biasing member 118 that includes a torsion spring in the illustrated embodiment (FIG. 5). As used in the present description and appended claims, to bias means to apply a force or urge in a desired direction. The valve element 110 is disposed substantially within the duct 102 and includes a valve body 122 rotatable with the pivot shaft 126 about a first axis 130 to define an open position (FIG. 6) and a closed position (FIG. 7) of the valve element 110. In the illustrated embodiment, the valve body 122 us a generally flat, rectangular valve body extending from the pivot shaft. In other embodiments, a rotary valve body may be used. In the open position, the motor and fan assembly 42 and the floor nozzle air inlet 98 are in fluid communication. In the closed position, the body 122 substantially blocks the duct 102 to inhibit fluid communication between the floor nozzle air inlet 98 and the motor and fan assembly 42. A crank arm or lever 134 is coupled to the pivot shaft 126 such that rotation of the lever 134 about the first axis 130 rotates the pivot shaft 126 and therefore, the body 122. In the illustrated embodiment, the wand 58 remains in fluid communication with the motor and fan assembly 42 irrespective of the position of the valve element 110. In this embodiment, the valve body 122 acts as a door opening and closing the duct to the nozzle while the duct to the wand remains open. Alternatively, a valve may be provided with a valve body that substantially blocks fluid communication to the wand when opening fluid communication to the nozzle, and substantially blocks fluid communication to the nozzle when opening fluid communication to the wand.

Figure 8:
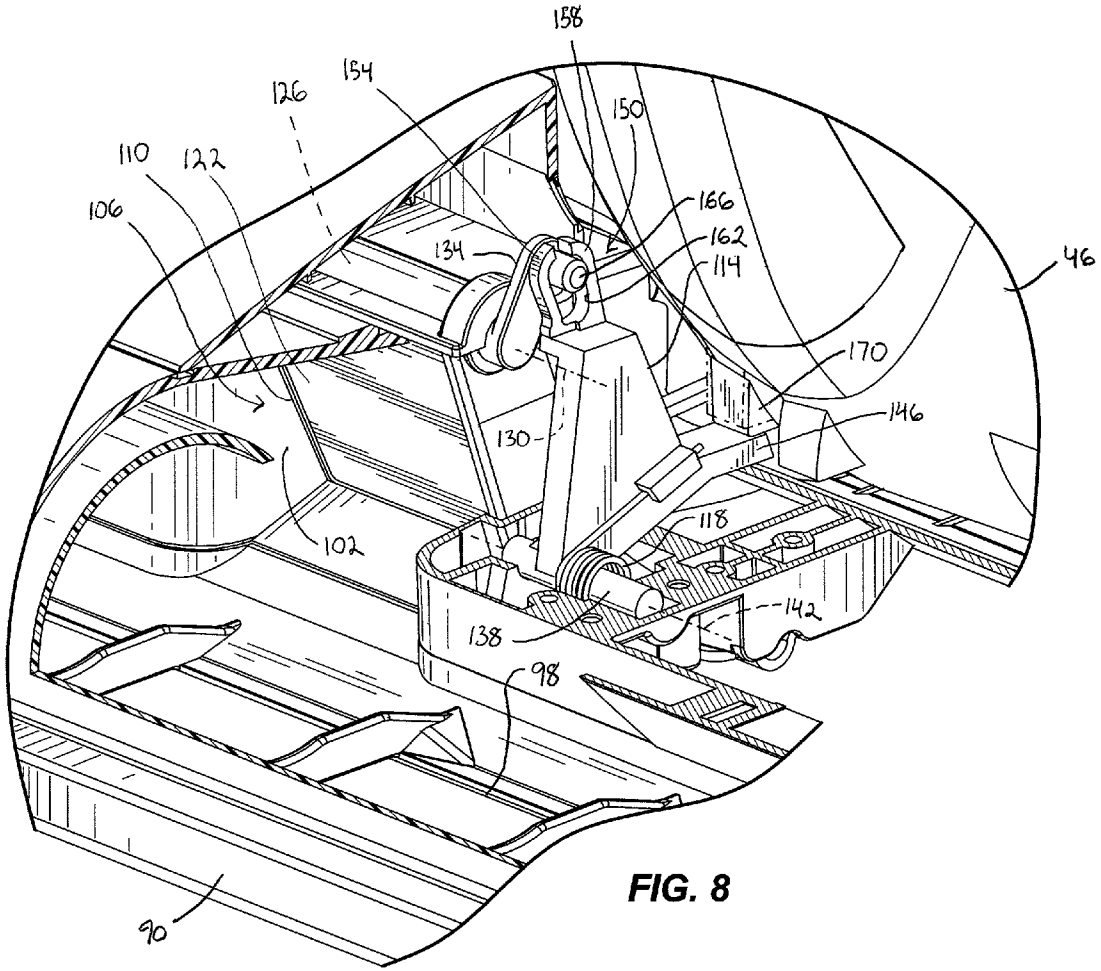
FIG. 8 is a cross-sectional view taken along line 6-6 in FIG. 1, illustrating the valve assembly in an over-travel position.

The link 114 includes a shaft 138 defining a second axis 142 generally parallel to and offset from the first axis 130, and a cam follower 146 (FIG. 5). The link 114 is coupled to the valve element 110 by a deformable portion 150 that allows the link 114 to move relative to the valve element 110 if the valve element 110 is stopped, such as when the valve element 110 is in the open position or the closed position. The deformable portion 150 may be located on one or both of the link 114 and the valve element 110. In the illustrated embodiment, the deformable portion 150 is configured as a living spring and includes first and second resilient arms 154, 158 extending from the link 114 to define an aperture 162 therebetween. In one alternative, the first and second resilient arms may be connected in a continuous loop (not shown) forming the aperture 162. In another alternative, one resilient arm may extend from the link in the shape of a hook or a loop forming an aperture. The aperture 162 receives a pin 166 extending from the lever 134 to couple the valve element 110 to the link 114. Accordingly, when the link 114 moves, the deformable portion 150 engages the pin 166 to rotate the valve element 110 between the open and closed positions. If the valve element 110 is stopped, one or both of the resilient arms 154, 158 bends or flexes to permit additional rotation of the link 114. For example, when the valve element 110 is in the closed position, continued rotation of the link 114 in the direction of arrow 178 causes the first resilient arm 154 to flex or bend against the pin 166, as illustrated in FIG. 8, relieving stress on the valve element 110. In the illustrated embodiment, the link 114 pivots around the second axis 142 to rotate the pivot shaft. Alternatively, the link may translate in a linear or nonlinear path or otherwise move to actuate the valve body.

In alternative embodiments, the deformable portion 150 may have any other structure for allowing the link 114 to move relative to the valve element 110 when the valve element 110 is stopped. For example, in some embodiments, the lever 134 or the pin 166 may be made of a flexible material. In other embodiments, a spring or any other elastically-deformable portion may interconnect the valve element 110 and the link 114.

With reference to FIGS. 5-7, the cam follower 146 on the link 114 is engageable with a cam 170 projecting from a front surface 174 of the motor housing 46. When the handle assembly 18 moves toward the upright position, the cam 170 engages the follower 146 to pivot the link 114 about the second axis 142, in the direction of arrow 178 (FIG. 5). When the handle assembly 18 moves toward the inclined position, the link 114 pivots about the second axis 142 in the direction of arrow 182 under the influence of the biasing member 118. In the illustrated embodiment, the biasing member 118 is a torsion spring; however, the biasing member 118 may include one or more coil springs, torsion bars, a spring member integrally molded with the link, or any other means for biasing the link 114 in the direction of arrow 182. When the handle assembly 18 is in the inclined position, the cam 170 is spaced from the follower 146 such that the link 114 pivots the valve element 110 to the closed position without being obstructed by the cam 170 (FIG. 6).

Figure 4:
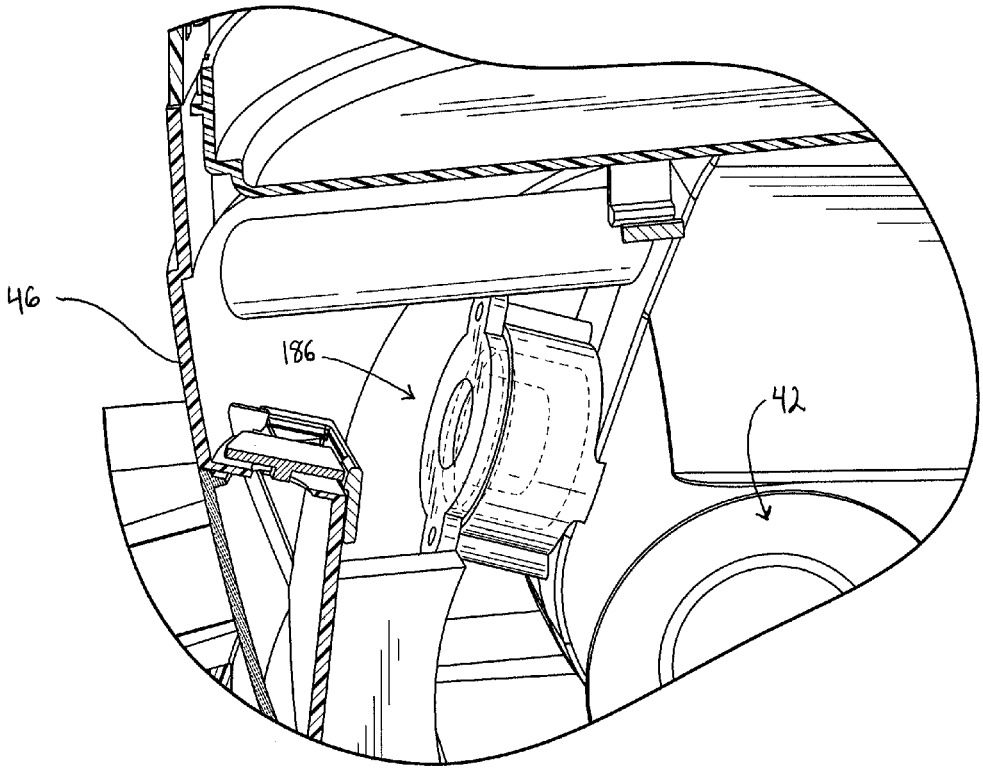
FIG. 4 is a cross-sectional view of a portion of a motor housing of the vacuum cleaner of FIG. 1, illustrating a bypass valve.

Referring to FIG. 4, the illustrated vacuum cleaner 10 includes a bypass valve 186 that opens in response to a predetermined suction pressure. Accordingly, the bypass valve 186 may open to provide continued airflow through the motor and fan assembly 42 if both of the nozzle and wand air inlets 74, 98 are blocked from fluid communication with the motor and fan assembly 42 (e.g., when the valve element 110 is in the closed position and the wand 58 is in the stowed position). In alternate embodiments, the bypass valve 186 may be omitted.

To operate the vacuum cleaner 10 in the floor cleaning mode in the illustrated embodiment, the wand 58 is stowed in the receptacle 78 closing the wand air inlet 74, and the handle assembly 18 is moved to the inclined position. As such, the cam 170 is spaced from the follower 146, and the biasing member 118 holds the valve element 110 in the open position (FIG. 6). As the motor and fan assembly 42 generates a suction airflow through the vacuum cleaner 10, air and any debris entrained therein are drawn into the floor nozzle 90 through its air inlet 98. The air and debris may then flow through the nozzle outlet duct 102 towards the separator 26. Although the wand 58 remains in fluid communication with the motor and fan assembly 42 irrespective of the position of the valve element 110, the seal 82 inhibits air from entering the wand air inlet 98 (FIG. 3). As such, substantially all of the airflow generated by the motor and fan assembly 42 is drawn through the floor nozzle air inlet 98.

To convert the vacuum cleaner 10 from the floor cleaning mode to the above-floor cleaning mode in the illustrated embodiment, the user pivots the handle assembly 18 toward the upright position illustrated in FIGS. 1 and 2. As the handle assembly 18 is pivoted toward the upright position, the cam 170 engages the follower 146 to pivot the link 114 about the second axis 142 in the direction of arrow 178 (FIG. 5). As the link 114 pivots, the deformable portion 150 engages the pin 166, causing the valve element 110 to pivot towards the closed position. When valve element 110 reaches the closed position, the body 122 substantially blocks the duct 102 to inhibit the passage of air therethrough (FIG. 7). In the illustrated embodiment, the valve element 110 reaches the closed position when the handle assembly 18 reaches the upright position.

In some embodiments, it may be possible to move the handle assembly 18 beyond the upright position to an over-travel position, illustrated in FIG. 8. For example, the vacuum cleaner 10 may include a latch (not shown) to secure the handle assembly 18 in the upright position, and it may be necessary to pivot the handle assembly 18 slightly beyond the upright position in order to fully engage the latch. If the handle assembly 18 continues to rotate beyond the upright position, the link 114 continues to pivot in the direction of arrow 178 due to the engagement between the cam 170 and follower 146. When the valve element 110 is stopped in the closed position, one or both of the resilient arms 154, 158 may bend or flex to permit the additional rotation of the link 114, thereby relieving stress on the valve element 110.

Once the handle assembly 18 is in the upright position and the valve element 110 is in the closed position, the user removes the wand 58 from the receptacle 78. When the motor and fan assembly 42 generates a suction airflow through the vacuum cleaner 10, air and any debris entrained therein are drawn into the wand 58 through the wand air inlet 74. Because the body 122 of the valve element 110 substantially blocks the duct 102 leading from the floor nozzle 90, substantially all of the airflow generated by the motor and fan assembly 42 is drawn through the wand 58 to facilitate above-floor cleaning If the handle assembly 18 is in the upright position when the wand 58 is stowed, the motor and fan assembly 42 is unable to draw air through either the floor nozzle 90 or the wand 58. In this situation, the bypass valve 186 opens, if present, to allow for continued airflow through the motor and fan assembly 42.

In both the floor cleaning mode and the above-floor cleaning mode of the vacuum cleaner 10, the air and debris drawn into the vacuum cleaner 10 (i.e. through the wand air inlet 74 or the floor nozzle air inlet 98) flows into the separator 42, which filters or otherwise cleans the airflow. The cleaned airflow is directed out of the canister 38 and into the motor housing 46 (e.g., via an airflow channel extending through the handle assembly 18). The cleaned airflow is ultimately exhausted back into the environment.

Various features of the invention are set forth in the following claims.

What is claimed is:

1. A vacuum cleaner comprising:

a suction source;

a base assembly including an air inlet;

a handle assembly pivotally coupled to the base assembly for movement relative to the base assembly between an upright position and an inclined position;

an airflow path extending from the air inlet to the suction source;

a valve including a pivot shaft, a valve body being rotatable with the pivot shaft, and a lever coupled to the pivot shaft such that rotation of the lever rotates the valve body between an open position in which the suction source and the air inlet are in fluid communication and a closed position inhibiting fluid communication between the air inlet and the suction source;

a link engaging the lever, the link movable in a first direction to open the valve and movable in a second direction to close the valve; and at least one of the lever and the link having a deformable portion, wherein the deformable portion is resiliently deformable to permit additional movement of the link when the valve body is stopped in the closed position or the open position, wherein the link further includes a follower and the handle assembly includes a cam engageable with the follower to move the link in the second direction;

wherein the air inlet is a first air inlet, the vacuum cleaner further comprising a wand removably coupled to the handle assembly, the wand having a second air inlet in fluid communication with the sunction source;

further comprising a seal engageable with the wand to substantially inhibit airflow through the second air inlet when the wand is coupled to the handle assembly; and further comprising a bypass valve in fluid communication with the suction source, the bypass valve being configured to open to provide a third air inlet when the valve is in the closed position and the seal is engaged to the wand.

2. The vacuum cleaner of claim 1, wherein the cam engages the follower when the handle assembly moves toward the upright position.

3. The vacuum cleaner of claim 1, wherein the cam is spaced from the follower when the handle assembly is in the inclined position.

4. The vacuum cleaner of claim 1, further comprising a biasing member configured to bias the link in the first direction.

5. The vacuum cleaner of claim 1, wherein the second air inlet is in fluid communication with the suction source irrespective of the position of the valve.

6. The vacuum cleaner of claim 1, wherein movement of the handle assembly from the inclined position to the upright position closes the valve.

7. A vacuum cleaner comprising:

a suction source;

a base assembly including an air inlet;

a handle assembly pivotally coupled to the base assembly for movement relative to the base assembly between an upright position and an inclined position;

an airflow path extending form the air inlet to the suction source;

a valve including a pivot shaft, a valve body being rotatable with the pivot shaft, and a lever coupled to the pivot shaft such that rotation of the lever rotates the valve body between an open position in which the suction source and the air inlet are in fluid communication and a closed position inhibiting fluid communication between the air inlet and the suction source;

a link engaging the lever, the link movable in a first direction to open the valve and movable in a second direction to close the valve; and wherein the deformable position is resiliently deformable to permit additional movement of the link when the valve body is stopped in the closed position or the open position, wherein the link includes the deformable portion including a first resilient arm, a second resilient arm, and an aperture defined between the first and the second resilient arms, wherein at least a portion of the lever extends through the aperture.

8. A vacuum cleaner comprising:

a suction source;

an air inlet;

an airflow path extending from the air inlet to the suction source;

a valve movable between an open position in which the suction source and the air inlet are in fluid communication and a closed position in which the valve substantially blocks the airflow path to inhibit fluid communication between the air inlet and the suction source; and a link engaging the valve such that rotation of the link in a first direction when the valve is in the closed position opens the valve, and rotation of the link in a second direction when the valve is in the open position closes the valve, wherein the link has a deformable portion resiliently deformable to permit additional movement of the link in the second direction when the valve is in the closed position;

wherein the air inlet is a first air inlet, the vacuum cleaner further comprising a second air inlet in fluid communication with the suction source;

further comprising a seal configured to selectively inhibit airflow through the second air inlet; and further comprising a bypass valve in fluid communication with the suction source, the bypass valve configured to open to provide a third air inlet when the valve is in the closed position and the seal inhibits airflow through the second air inlet.

9. The vacuum cleaner of claim 8, further comprising a biasing member configured to bias the link in the first direction.

10. The vacuum cleaner of claim 8, wherein the second air inlet is in fluid communication with the suction source irrespective of the position of the valve.

11. The vacuum cleaner of claim 8, wherein the valve includes a pivot shaft, a valve body extending from the pivot shaft and rotatable with the pivot shaft, and a lever coupled to the pivot shaft such that movement of the lever moves the valve body between the open position the closed position.

12. The vacuum cleaner of claim 8, further comprising a base assembly; and a handle assembly pivotally coupled to the base assembly for movement relative to the base assembly between an upright position and an inclined position, wherein movement of the handle assembly from the inclined position to the upright position closes the valve.

13. A vacuum cleaner comprising:

a suction source;

an air inlet;

an airflow path extending from the air inlet to the suction source;

a valve movable between an open position in which the suction source and the air inlet are in fluid communication and a closed position in which the valve substantially blocks the airflow path to inhibit fluid communication between the air inlet and the suction source, and a link coupled to the valve such that movement of the link in a first direction when the valve is in the closed position opens the valve, and the movement of the link in a second direction when the valve is in the open position closes the valve, wherein the link has a deformable portion resiliently deformable to permit additional movement of the link in the second direction when the valve is in the closed position, wherein the deformable portion includes a first resilient arm, a second resilient arm, and an aperture defined between the first and second resilient arms, wherein at least a portion of the crank extends through the aperture.

* * * * *